US006797671B2

(12) United States Patent
Tamura et al.

(10) Patent No.: US 6,797,671 B2
(45) Date of Patent: Sep. 28, 2004

(54) METHOD FOR IMAGE FORMATION AND IMAGE-FORMED PRODUCT

(75) Inventors: Yoshihiko Tamura, Shinjuku-Ku (JP); Kenichi Aso, Shinjuku-Ku (JP)

(73) Assignee: Dai Nippon Printing Co., Ltd. (JP)

( * ) Notice: Subject to any disclaimer, the term of this patent is extended or adjusted under 35 U.S.C. 154(b) by 99 days.

(21) Appl. No.: 10/307,430

(22) Filed: Dec. 2, 2002

(65) Prior Publication Data

US 2003/0157356 A1 Aug. 21, 2003

(30) Foreign Application Priority Data

Nov. 30, 2001 (JP) ..... 2001-367203

(51) Int. Cl.[7] ..... B41M 5/40

(52) U.S. Cl. ..... 503/227; 156/235; 428/32.75; 428/32.77; 428/32.78; 428/32.79

(58) Field of Search ..... 156/235; 428/32.75, 428/32.77, 32.78, 32.79; 503/227

(56) References Cited

U.S. PATENT DOCUMENTS

| | | | | |
|---|---|---|---|---|
| 5,656,570 | A | 8/1997 | Imai et al. | 503/227 |
| 6,284,708 | B1 | 9/2001 | Oshima et al. | 503/227 |
| 2001/0046592 | A1 | 11/2001 | Oshima et al. | 428/195 |

FOREIGN PATENT DOCUMENTS

| | | |
|---|---|---|
| EP | 0 407 615 A1 | 1/1991 |
| EP | 0 838 347 A1 | 4/1998 |
| JP | 03-159795 | 7/1991 |
| JP | 2000-177249 | 6/2000 |

*Primary Examiner*—B. Hamilton Hess
(74) *Attorney, Agent, or Firm*—Parkhurst & Wendel, L.L.P.

(57) ABSTRACT

There are provided a method for image formation which can produce an image formed object possessing excellent fastness or resistance properties such as excellent abrasion resistance, lightfastness, and alteration preventive properties, is less likely to cause damage to an object, is free from a deterioration in image quality, and does not incur an increase in production cost, and an image formed object. In the method for image formation, an intermediate transfer recording medium comprising a substrate and a light transparent protective layer provided on the substrate, and a first thermal transfer recording medium comprising a substrate and a light transparent ink layer provided on the substrate are first provided. The intermediate transfer recording medium and the first thermal transfer recording medium are put on top of each other. The assembly is imagewise heated to form a light transparent image on the light transparent protective layer in the intermediate transfer recording medium. The intermediate transfer recording medium with the light transparent image formed thereon is put on top of a second thermal transfer recording medium comprising a substrate and a color ink layer provided on one side of the substrate. The assembly is imagewise heated to transfer the color ink layer onto the light transparent protective layer on its light transparent image-formed side, whereby a color image is formed on the light transparent protective layer. An object is then put on top of the intermediate transfer recording medium with the images formed on its light transparent protective layer. The whole assembly is heated to form a color image, a light transparent image, and a light transparent protective layer on the object.

8 Claims, 1 Drawing Sheet

METHOD FOR IMAGE FORMATION AND IMAGE-FORMED PRODUCT

BACKGROUND OF THE INVENTION

1. Field of the Invention

The present invention relates to a method for image formation, wherein a color image, a light transparent image, and a light transparent protective layer are formed on an object by using an intermediate transfer recording medium comprising a substrate and a light transparent protective layer provided on one side of the substrate, a first thermal transfer recording medium comprising a substrate and a light transparent ink layer provided on one side of the substrate, and a second thermal transfer recording medium comprising a substrate and, provided on one side of the substrate, a color ink layer comprising a thermoplastic resin and a colorant. The present invention relates also to an image formed object produced by the method for image formation.

2. Prior Art

Thermal transfer can easily record variable information and thus is extensively used in a wide variety of applications. The thermal transfer is a method which comprises the steps of: putting a thermal transfer film, comprising a colorant layer provided on a substrate, on top of an object optionally provided with a receptive layer; pressing the assembly between a heating device, such as a thermal head, and a platen roll; and selectively heating the heating device in its heating portion according to image information to transfer the colorant contained in the colorant layer on the thermal transfer film onto the object, whereby an image is recorded on the object. Thermal transfer methods are roughly classified into thermal ink transfer (hot melt-type thermal transfer) and thermal dye sublimation transfer (sublimation-type thermal transfer).

The thermal ink transfer is a method for image formation wherein a thermal transfer film bearing thereon a heat-fusion ink layer is heated by the above heating means and the component of the softened heat-fusion ink layer is transferred onto an object such as natural fiber paper or plastic sheet to form an image. The heat-fusion ink layer used herein is formed of a dispersion of a colorant, such as a pigment, in a binder, such as heat-fusion wax or resin and is supported on a substrate such as a plastic film. The formed image has high density and high sharpness, and this method is suitable for recording binary images such as characters and line drawings.

On the other hand, the thermal dye sublimation transfer is a method for image formation wherein a thermal transfer film bearing thereon a sublimable dye layer is heated by the above heating means to sublimate and transfer the sublimable dye contained in the dye layer onto a receptive layer provided on an object, whereby an image is formed on the object. The sublimable dye layer used herein is formed of a solution or dispersion of a sublimable dye used as the colorant in a binder resin and is supported on a substrate film such as a plastic film. According to this method, since the amount of the dye transferred can be regulated dot by dot according to the quantity of energy applied to a heating device, such as a thermal head, the reproduction of gradation can be realized by varying the density.

Thus, the thermal ink transfer method and the thermal dye sublimation transfer method have respective features, that is, the thermal ink transfer method can easily and clearly form images of characters, numerals and the like, while the thermal dye sublimation transfer method is excellent in gradation rendering and can form images such as a photograph-like image of a face in a faithful, clear manner.

Images formed by the above thermal transfer methods, independently of whether the images have been formed by the thermal ink transfer method or the thermal dye sublimation transfer method, are unsatisfactory in fastness or resistance properties such as abrasion resistance, lightfastness, and alteration preventive properties. To cope with the unsatisfactory fastness or resistance properties, a protective layer has hitherto been formed on the image. For example, Japanese Patent Laid-Open No. 159795/1991 describes that information such as images and characters are formed on a card substrate and a transparent protective layer is provided on at least a part of the surface of the information. In this case, for example, two or more protective layers are transferred so that they overlap with each other and are different from each other in transfer area. At least one of the protective layers contains a brightening agent and/or an ultraviolet absorber. In this method, however, since the transfer of the protective layer onto the object (card) is carried out twice or more, damage to the object is large. Further, the number of steps (transfer) necessary for preparing a print is large, and a great deal of time is required. Therefore, for example, a deterioration in print quality and an increase in production cost are disadvantageously likely to occur.

Japanese Patent Laid-Open No. 177249/2000 describes a record produced by forming a color image on recording paper and forming a transparent image of a transparent ink on the color image and further discloses that an overcoat is formed between the color image and the transparent image. The claimed advantage of the record is to improve the weathering resistance and abrasion resistance of the color image and to permit the transparent image on the color image to be viewed by the reflection of light according to the angle of the line of sight to the transparent image recorded face. Also in this case, however, since the transfer onto the color image on the recording paper is carried out a plurality of times, that is, since the transparent image and the overcoat are transferred onto the color image on the recording paper, damage to the object is significant. Further, the number of steps (transfer) necessary for preparing a print is large, and a great deal of time is required. Therefore, for example, a deterioration in print quality and an increase in production cost are disadvantageously likely to occur.

SUMMARY OF THE INVENTION

The present invention has been made with a view to solving the above problems of the prior art, and it is an object of the present invention to provide a method for image formation which can produce an image formed object possessing excellent fastness or resistance properties such as excellent abrasion resistance, lightfastness, and alteration preventive property, is less likely to cause damage to an object, is free from a deterioration in quality of the image, and does not incur an increase in production cost, and to provide an image formed object.

The above object can be attained by a method for image formation, comprising the steps of: providing an intermediate transfer recording medium comprising a substrate and a light transparent protective layer provided on one side of the substrate; providing a first thermal transfer recording medium comprising a substrate and a light transparent ink layer provided on one side of the substrate; putting the intermediate transfer recording medium and the first thermal transfer recording medium on top of each other so that the light transparent protective layer in the intermediate transfer recording medium faces the light transparent ink layer in the first thermal transfer recording medium; imagewise heating the assembly to form a light transparent image on the light transparent protective layer in the intermediate transfer recording medium; providing a second thermal transfer recording medium comprising a substrate and, provided on one side of the substrate, a color ink layer comprising a thermoplastic resin and a colorant; putting the intermediate transfer recording medium with the light transparent image formed thereon on top of the second thermal transfer recording medium so that the light transparent protective layer on its light transparent image-formed side in the intermediate transfer recording medium faces the color ink layer in the second thermal transfer recording medium; imagewise heating the assembly to transfer the color ink layer or the colorant contained in the color ink layer onto the light transparent protective layer on its light transparent image-formed side in the intermediate transfer recording medium, whereby a color image is formed on the light transparent protective layer; putting an object on top of the intermediate transfer recording medium with the light transparent image and the color image formed on its light transparent protective layer so that the light transparent image and the color image face the object; and heating the whole assembly to form a color image, a light transparent image, and a light transparent protective layer on the object.

According to the present invention, there is provided an image formed object comprising an image formed by the above method for image formation.

In the image formed object according to the present invention, the thickness of the light transparent image is preferably 0.3 to 5.0 $\mu$m.

The light transparent protective layer is preferably composed mainly of a thermoplastic resin having a glass transition point of 50 to 120° C.

Preferably, the thermoplastic resin is at least one member selected from a polyester resin having a number average molecular weight of 2000 to 30000, a vinyl chloride-vinyl acetate copolymer having an average degree of polymerization of 150 to 500, and a homopolymer or copolymer, of a methacrylate monomer, having a weight average molecular weight of 20000 to 80000.

Preferably, the light transparent ink layer for the formation of light transparent image is composed mainly a thermoplastic resin having a glass transition point of 50 to 120° C.

Preferably, the thermoplastic resin is at least one member selected from a polyester resin having a number average molecular weight of 2000 to 30000, a vinyl chloride-vinyl acetate copolymer having an average degree of polymerization of 150 to 500, and a homopolymer or copolymer, of a methacrylate monomer, having a weight average molecular weight of 20000 to 80000.

Preferably, both the light transparent ink layer, for the formation of the light transparent image, and the light transparent protective layer contain respective thermoplastic resins, and the thermoplastic resin contained in the light transparent ink layer and the thermoplastic resin contained in the light transparent protective layer are analogous to each other in polymer structure and each have an ester linkage in its molecular structure.

The image formed object according to the present invention is produced as follows. An intermediate transfer recording medium comprising a substrate and a light transparent protective layer provided on one side of the substrate, and a first thermal transfer recording medium comprising a substrate and a light transparent ink layer provided on one side of the substrate are first provided. The intermediate transfer recording medium and the first thermal transfer recording medium are put on top of each other so that the light transparent protective layer in the intermediate transfer recording medium faces the light transparent ink layer in the first thermal transfer recording medium. The assembly is imagewise heated to form a light transparent image on the light transparent protective layer in the intermediate transfer recording medium. The intermediate transfer recording medium with the light transparent image formed thereon is then put on top of a second thermal transfer recording medium comprising a substrate and, provided on one side of the substrate, a color ink layer comprising a thermoplastic resin and a colorant so that the light transparent protective layer on its light transparent image-formed side in the intermediate transfer recording medium faces the color ink layer in the second thermal transfer recording medium. The assembly is imagewise heated to transfer the color ink layer or the colorant contained in the color ink layer onto the light transparent protective layer on its light transparent image-formed side in the intermediate transfer recording medium, whereby a color image is formed on the light transparent protective layer. An object is then put on top of the intermediate transfer recording medium with the light transparent image and the color image formed on its light transparent protective layer so that the light transparent image and the color image face the object. The whole assembly is heated to form a color image, a light transparent image, and a light transparent protective layer on the object.

In the image formed object thus obtained, the image formed by the transfer of the color ink layer is protected by the light transparent protective layer and, further, by virtue of a combination thereof with the light transparent image, has excellent fastness or resistance properties such as excellent abrasion resistance, lightfastness, and alteration preventive properties. Further, for example, according to the angle of the line of sight to the image-recorded face in the image formed object, the convex portion in the light transparent image transferred to the object is legible by the reflection of light.

Further, a protective layer having on its surface a color image and a light transparent image can be formed on an object by single transfer operation using an intermediate transfer recording medium comprising a light transparent protective layer having on its surface a color image, formed by the transfer of a color ink layer, and a light transparent image formed by the transfer of a light transparent ink layer. Therefore, the damage to the object by the transfer operation is less likely to occur, and a deterioration in image quality and an increase in production cost can be suppressed.

DETAILED DESCRIPTION OF THE INVENTION

Figure 1:
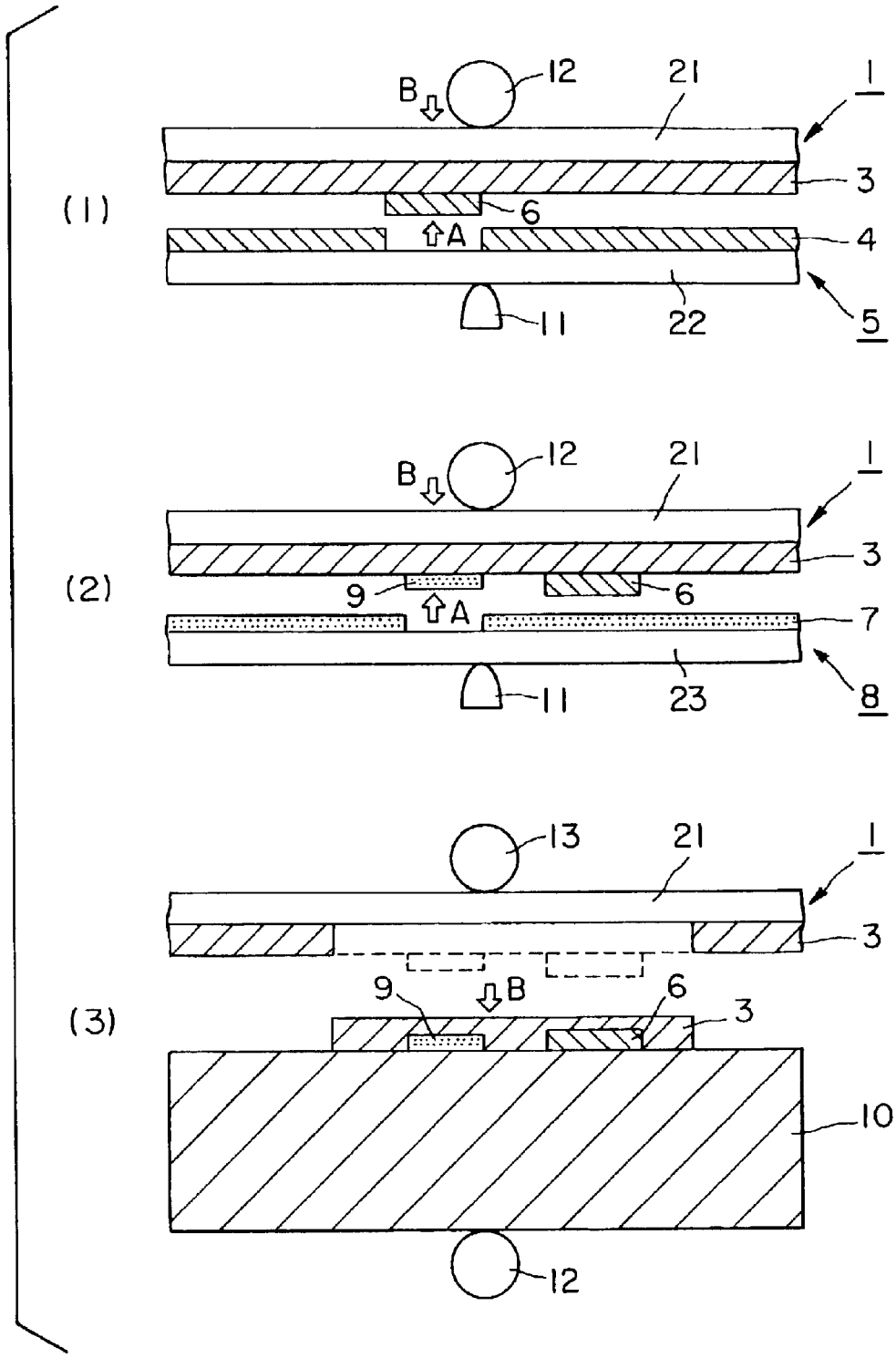
FIG. 1 is a schematic diagram illustrating the method for image formation according to the present invention.

The present invention will be described in more detail with reference to the following preferred embodiments.

FIG. 1 is a schematic diagram illustrating the method for image formation according to the present invention. An intermediate transfer recording medium 1 comprising a substrate 21 and a light transparent protective layer 3 provided on one side of the substrate 21 is provided. A first thermal transfer recording medium 5 comprising a substrate 22 and a light transparent ink layer 4 provided on one side of the substrate 22 is also provided. The intermediate transfer recording medium 1 and the first thermal transfer recording medium 5 are put on top of each other so that the light transparent protective layer 3 faces the light transparent ink layer 4. The assembly is then imagewise heated to form a light transparent image 6 on the light transparent protective layer 3 in the intermediate transfer recording medium 1. In this case, the heating is carried out by means of a thermal head 11 in such a manner that the intermediate transfer recording medium 1 and the first thermal transfer recording medium 5 are sandwiched between the thermal head 11 and a platen roll 12 and the assembly is imagewise heated by means of the thermal head 11 from the first thermal transfer recording medium 5 on its side remote from the light transparent ink layer 4 (see FIG. 1 (1)).

When this light transparent image 6 is viewed in a direction indicated by A, the light transparent image 6 is a reverse image (a mirror image), while, when this image 6 is viewed in a direction indicated by B, the image 6 is a non-reverse image.

Next, a second thermal transfer recording medium 8 comprising a substrate 23 and, provided on one side of the substrate 23, a color ink layer 7 comprising a thermoplastic resin and a colorant is provided. The intermediate transfer recording medium 1 with the light transparent image 6 formed thereon is put on top of the second thermal transfer recording medium 8 so that the light transparent protective layer 3 with the light transparent image 6 formed thereon faces the color ink layer 7. The assembly is imagewise heated to transfer the color ink layer 7 or a colorant contained in the color ink layer 7 onto the light transparent protective layer 3 with the light transparent image 6 formed thereon in the intermediate transfer recording medium 1 to form a color image 9. The heating is carried out by means of the thermal head 11 in such a manner that the intermediate transfer recording medium 1 and the second thermal transfer recording medium 8 are sandwiched between the thermal head 11 and the platen roll 12 and the assembly is imagewise heated by means of the thermal head 11 from the second thermal transfer recording medium 8 on its side remote from the color ink layer 7 (see FIG. 1 (2)).

When this color image 9 is viewed in a direction indicated by A, the color image 9 is a reverse image (a mirror image), while, when this image 9 is viewed in a direction indicated by B, the image 9 is a non-reverse image.

Next, the intermediate transfer recording medium 1 and an object 10 are put on top of each other so that the light transparent protective layer 3 with the light transparent image 6 and the color image 9 formed thereon in the intermediate transfer recording medium 1 faces the image forming face of the object 10. The assembly is heated by means of a heat roll 13 from the intermediate transfer recording medium 1 on its side remote from the light transparent protective layer 3. In the heating by means of the heat roll 13, the intermediate transfer recording medium 1 and the object 10 are sandwiched between the heat roll 13 and the platen roll 12, and, in this state, the assembly is heated and pressed. After the heating, the stacked intermediate transfer recording medium 1 and the object 10 are separated from each other. Thus, in the portion heated by the heat roll 13, the light transparent protective layer 3, together with the light transparent image 6 and the color image 9, in the intermediate transfer recording medium 1 is transferred onto the object 10 (see FIG. 1 (3)).

The light transparent image 6 and the color image 9 provided on the object 10 are covered with and protected by the light transparent protective layer 3 and thus possess excellent fastness or resistance properties such as excellent abrasion resistance, lightfastness, and alteration preventive properties. In the image formed object, when the light transparent image 6 and the color image 9 are viewed in a direction indicated by B, the images each are a non-reverse image.

Next, each layer constituting the intermediate transfer recording medium, the first thermal transfer recording medium, and the second thermal transfer recording medium, the thermal transfer means and the like used in the method for image formation according to the present invention will be described in detail.

<Intermediate Transfer Recording Medium>

Each layer constituting the intermediate transfer recording medium 1 used in the method for image formation according to the present invention will be described.

Substrate

The same substrate as used in the conventional intermediate transfer recording medium as such may be used as the substrate 2 (21) in the intermediate transfer recording medium according to the present invention. Further, substrates having a surface subjected to easy-adhesion treatment and the like may also be adopted without particular limitation. Specific examples of preferred substrates include: films of plastics including polyethylene terephthalate and, further, polyesters, polycarbonates, polyamides, polyimides, cellulose acetate, polyvinylidene chloride, polyvinyl chloride, polystyrene, fluororesin, polypropylene, polyethylene, and ionomers; papers such as glassine paper, capacitor paper, and paraffin-waxed paper; and cellophane. Further, for example, a composite film produced by stacking two or more of them on top of each other or one another may be used. The thickness of the substrate 2 may properly vary depending upon materials so that the substrate has proper strength and heat resistance. In general, however, the thickness of the substrate 2 is preferably about 2 to 100 $\mu$m.

Light Transparent Protective Layer

The light transparent protective layer 3 provided on the substrate in the intermediate transfer recording medium used in the present invention, together with the light transparent image 6, formed by the transfer of the light transparent ink layer 4 in the first thermal transfer recording medium 5, and the color image 9 formed by the transfer of the color ink layer 7 in the second thermal transfer recording medium 8, is transferred onto the object 10. The transferred light transparent protective layer 3 functions as a protective layer for the images 6 and 9 and contributes to fastness or resistance properties, such as abrasion resistance, lightfastness, and alteration preventive properties, of these images. Further, for example, the light transparent image 6 formed by the transfer of the light transparent ink layer 4 is legible by the reflection of light according to the angle of the line of sight to the transferred face. Therefore, the image formed object has alteration preventive properties and a good three-dimensional appearance (see FIG. 1).

The light transparent protective layer may be formed of a proper resin having excellent abrasion resistance, transparency, hardness and other properties. Specific examples of resins usable herein include polyester resin, vinyl chloride-vinyl acetate copolymer, polystyrene resin, acrylic resin, polyurethane resin, acrylated urethane resin, silicone-modified products of these resins, polycarbonate resin, and mixtures of these resins. For example, a resin produced by crosslinking and curing an acrylic monomer or the like by ionizing radiation irradiation may also be used. Specific examples of acrylic monomers include ethylene glycol di(meth)acrylate, hexanediol di(meth)acrylate, trimethylolpropane tri(meth)acrylate, trimethylolpropane di(meth)acrylate, pentaerythritol tetra(meth)acrylate, dipentaerythritol hexa(meth)acrylate, ethylene glycol diglycidyl ether di(meth)acrylate, propylene glycol diglycidyl ether di(meth)acrylate, and sorbitol tetraglycidyl ether tetra(meth) acrylate. The material to be cured by the ionizing radiation is not limited to the monomer and may also be used as an oligomer. Further, polymers or derivatives of the above materials, reactive acrylic polymers, such as polyester acrylate, epoxy acrylate, urethane acrylate, and polyether acrylate polymers, may be used. The above materials may also be used in combination with other acrylic resin(s).

These resins may contain, for example, highly transparent fine particles of silica, alumina, calcium carbonate, plastic pigment or the like or wax, from the viewpoint of the transferability of these resins in such an amount that is not detrimental to the transparency. Further, these resins may contain lubricants or the like from the viewpoint of improving abrasion resistance, gloss and the like of the image.

The light transparent protective layer is preferably composed mainly of a thermoplastic resin having a glass transition point of 50 to 120° C. This can improve the transferability and fixation of the light transparent protective layer onto the object. This thermoplastic resin is particularly preferably a polyester resin having a number average molecular weight of 2000 to 30000, a vinyl chloride-vinyl acetate copolymer having an average degree of polymerization of 150 to 500, or a homopolymer or copolymer, of a methacrylate monomer, having a weight average molecular weight of 20000 to 80000. In this case, upon transfer of the light transparent protective layer onto the object, the light transparent protective layer functions as a protective layer which can impart excellent fastness or resistance properties such as excellent abrasion resistance and lightfastness to the image.

In the polyester resin, examples of aromatic acids usable as the acid component include terephthalic acid, isophthalic acid, o-phthalic acid, and 2,6-naphthalenedicarboxylic acid, and examples of aliphatic or alicyclic dicarboxylic acids usable as the acid component include succinic acid, adipic acid, azelaic acid, sebacic acid, dodecanedioic acid, dimmer acid, tetrahydrophthalic acid, hexahydrophthalic acid, hexahydroisophthalic acid, and hexahydroterephthalic acid. Tri- or higher functional polycarboxylic acids, such as trimellitic acid and pyromellitic acid, may also be used.

In the intermediate transfer recording medium used in the present invention, preferably, the light transparent protective layer is formed of a polyester resin particularly using terephthalic acid, isophthalic acid, and trimellitic acid as constituent monomers of the acid component. In this case, upon transfer of the light transparent protective layer onto the object, the light transparent protective layer functions as a protective layer which can impart excellent fastness or resistance properties such as excellent abrasion resistance and lightfastness.

Examples of the alcohol component as another material of the polyester resin include ethylene glycol, 1,2-propylene glycol, 1,3-propanediol, 1,4-butanediol, neopentyl glycol, 1,5-pentanediol, 1,6-hexanediol, 1,4-cyclohexanedimethanol, and tricyclodecane glycol. From the viewpoints of fastness or resistance properties, such as abrasion resistance and lightfastness, transferability, fixation and the like as the protective layer, a polyester resin particularly using at least two or more of ethylene glycol, neopentyl glycol, and tricyclodecane glycol as constituent monomers is preferred because the glass transition point can be easily regulated to the range of 50 to 120° C.

A vinyl chloride-vinyl acetate copolymer may be mentioned as a preferred thermoplastic resin used in the light transparent protective layer. The vinyl chloride-vinyl acetate copolymer preferably has a glass transition point in the range of 50 to 120° C. and an average degree of polymerization in the range of 150 to 500. In producing this vinyl chloride-vinyl acetate copolymer, preferably, 5 to 40% by weight of a vinyl acetate monomer is formulated. When the amount of vinyl acetate formulated is above the upper limit of the above-defined amount range, blocking is likely to occur. On the other hand, when the amount of vinyl acetate formulated is below the lower limit of the above-defined amount range, the solubility of the copolymer in a solvent at the time of coating of the copolymer onto the substrate is so low that the coatability is poor.

The thermoplastic resin constituting the light transparent protective layer is preferably a homopolymer or copolymer of a methacrylate monomer, the homopolymer or copolymer having a glass transition point of 50 to 120° C. and a weight average molecular weight of 20000 to 80000.

Methacrylate monomers usable herein include, for example, methyl methacrylate, ethyl methacrylate, n-propyl methacrylate, i-propyl methacrylate, n-butyl methacrylate, i-butyl methacrylate, sec-butyl methacrylate, cyclohexyl methacrylate, benzyl methacrylate, 2-ethylhexyl methacrylate, 2-hydroxyethyl methacrylate, and 2-hydroxypropyl methacrylate.

The light transparent protective layer in the intermediate transfer recording medium used in the present invention is preferably transparent or translucent so that, upon transfer of the light transparent protective layer onto the object, the color image derived from the color ink layer in the second thermal transfer recording medium can be seen through the light transparent protective layer. "Translucent" refers to a state intermediate between a transparent state and an opaque state. That is, when the light transparent protective layer is transparent to light, the difference in refractive index of light between the color image portion derived from the color ink layer in the second thermal transfer recording medium and the light transparent protective layer transferred onto the object is so small that, when the image formed object is viewed, the color image portion can be easily seen through the light transparent protective layer. On the other hand, when the light transparent protective layer is opaque, the difference in refractive index of light between the color image portion derived from the color ink layer in the second thermal transfer recording medium and the light transparent protective layer portion transferred onto the object is so large that the color image portion cannot be seen through the protective layer, that is, light cannot pass through the protective layer.

Methods usable for regulating the transparency or light transmission property of the light transparent protective layer include one wherein a conventional colorant is incorporated into the light transparent protective layer, one wherein particles are incorporated into the light transparent protective layer, and one wherein the structure of the light transparent protective layer is brought to a porous network structure.

Among organic or inorganic pigments or dyes, cyan, magenta, yellow, black or other hues may be properly selected as the colorant. Pigments having a metallic luster, such as gold color, silver color, or copper color, fluorescent inorganic or organic pigments or dyes, and pigments or dyes of white or intermediate colors such as green, orange, and purple, may also be used. In this case, the amount of the colorant added should be regulated so that the colorant does not conceal the light transparent image portion derived from the light transparent ink layer in the first thermal transfer recording medium and the color image portion derived from the color ink layer in the second thermal transfer recording medium and permits the light transparent image portion and the color image portion to be seen through the light transparent protective layer. In order to enhance the light transmission property, the colorant is preferably in the state of dissolution in the coating liquid for the light transparent protective layer. From this point of view, the use of the dye as the colorant is preferred.

Preferred particles usable for regulating the transparency or light transmission property of the light transparent protective layer include inorganic particles, such as particles of silica, titanium oxide, and calcium carbonate, and organic particles such as synthetic resin fillers.

The porous network structure of the light transparent protective layer can be formed by a conventional method. For example, a transparent resin varnish, as a coating liquid for the light transparent protective layer, comprising a resin, a good solvent having a relatively low boiling point, and a poor solvent having a relatively high boiling point is coated onto a substrate. This resin varnish is coated by a conventional coating method, such as gravure coating or silk screen coating. Next, resin varnish coating is dried. In this step of drying, the good solvent having a relatively low boiling point preferentially evaporates. As the evaporation of the good solvent proceeds, the resin phase in the resin varnish is separated from the remaining poor solvent phase. In this case, the resin gels, while the poor solvent takes the form of particles dispersed in the resin. As drying further proceeds, the evaporation of the high-boiling poor solvent in a particle form proceeds. Upon the completion of the evaporation of the poor solvent, the light transparent protective layer having a porous structure is formed. The pore diameter of the porous structure can be regulated by regulating the temperature, air flow and the like at the time of drying. In this connection, the following point should be noted. In the case of the light transparent protective layer having a porous structure, the pore diameter of the porous structure is regulated by taking into consideration the transparency and light transmission properties of the light transparent protective layer after transfer onto the object, rather than the transparency and light transmission properties of the light transparent protective layer in the intermediate transfer recording medium. This is because, in the light transparent protective layer having a porous structure, in some cases, heating at the time of thermal transfer of the protective layer causes a change in porous structure and consequently somewhat enhances the transparency and light transmission properties.

The light transparent protective layer may be formed by adding necessary additives to the above resin for the light transparent protective layer, dissolving the mixture in a suitable organic solvent or dispersing the mixture in an organic solvent or water, coating the solution or dispersion onto a substrate by forming means, such as gravure coating, gravure reverse coating, or roll coating, and drying the coating. The light transparent protective layer may be formed in any desired thickness. Preferably, the coverage of the light transparent protective layer is 0.1 to 50 g/m$^2$, more preferably 0.2 to 10 g/m$^2$, on a dry basis.

In the intermediate transfer recording medium used in the present invention, a light transparent protective layer is provided separably on the substrate. The light transparent protective layer may be provided on the substrate through a release layer. In this case, upon heating, the light transparent protective layer can be more easily separated from the substrate. At the time of the thermal transfer, the release layer is not separated from the substrate and stays on the substrate side.

Release Layer

In the intermediate transfer recording medium, some combination of the material for the substrate with the material for the light transparent protective layer sometimes results in unsatisfactory separation of the light transparent protective layer from the substrate at the time of the thermal transfer. In this case, a release layer may be previously provided on the substrate. The release layer may be formed of one material or a mixture of two or more materials selected from waxes, silicone waxes, and resins such as silicone resins, fluororesins, acrylic resins, polyvinyl alcohol, urethane resins, cellulosic resins such as cellulose acetate, polyvinyl acetal resins, and polyvinyl butyral resins. When two or more materials are mixed, a water-soluble resin may be used according to need. The release layer may be formed by coating a coating liquid composed mainly of these resins by a conventional method, such as gravure coating or gravure reverse coating, and drying the coating. A coverage of the coating of about 0.01 to 2 g/m$^2$ suffices for the release layer. In selecting the material for the release layer, attention should be paid to proper separability of the release layer from the light transparent protective layer, as well as to the satisfaction of a requirement that the adhesion between the release layer and the substrate is larger than the adhesion between the release layer and the light transparent protective layer. Unsatisfactory adhesion between the release layer and the substrate is causative of abnormal transfer such as transfer of the release layer together with the thermal transfer layer. When a matte appearance is desired in the print after the transfer of the transfer layer, the surface of the print after the transfer of the light transparent protective layer can be rendered matte by incorporating various particles into the release layer or by using a substrate of which the surface on the release layer side has been rendered matte.

In the intermediate transfer recording medium used in the present invention, the light transparent protective layer is provided separably on the substrate. The light transparent protective layer may be provided on the substrate through a peel layer. In this case, upon heating, the light transparent protective layer can be more easily separated from the substrate. This peel layer can be separated from the substrate at the time of thermal transfer.

Peel Layer

The peel layer may be formed by coating a coating liquid containing, for example, waxes, silicone waxes, silicone resins, fluororesins, acrylic resins, polyvinyl alcohol resins, cellulose derivative resins, polyvinyl acetal resins, polyvinyl butyral resins, vinyl chloride-vinyl acetate copolymer, or chlorinated polyolefin or a copolymer of a group of these resins or the like by conventional forming means such as gravure printing, screen printing, or reverse roll coating using a gravure plate, and drying the coating.

The coverage of the peel layer is about 0.01 to 5 g/m$^2$ on a dry basis.

Adhesive Layer

In the intermediate transfer recording medium, an adhesive layer may be provided on the light transparent protective layer provided on the substrate to improve the fixation of the light transparent protective layer onto an object at the time of the thermal transfer. The adhesive layer is preferably formed of a material which, upon heating, can develop an adhesive property. For example, the adhesive layer may be formed using thermoplastic synthetic resin, naturally occurring resin, rubber, wax or the like by the same forming means as used in the formation of the peel layer. The coverage of the adhesive layer is about 0.01 to 5 g/m$^2$.

<First Thermal Transfer Recording Medium>

Next, a first thermal transfer recording medium 5 comprising a substrate 22 and a light transparent ink layer 4 provided on one side of the substrate 22 used in the present invention will be described.

Substrate

The same substrate as used in the conventional thermal transfer recording medium as such may be used as the substrate 22 in the first thermal transfer recording medium, and examples thereof include those as described above in connection with the intermediate transfer recording medium.

Light Transparent Ink Layer

The light transparent ink layer may be formed of the same material as described above in connection with the light transparent protective layer in the intermediate transfer recording medium, such as thermoplastic resins. The light transparent ink layer is preferably composed mainly of a thermoplastic resin having a glass transition point of 50 to 120° C. This can improve the transferability and fixation of the light transparent ink layer onto the object (intermediate transfer recording medium). This thermoplastic resin is particularly preferably a polyester resin having a number average molecular weight of 2000 to 30000, a vinyl chloride-vinyl acetate copolymer having an average degree of polymerization of 150 to 500, or a homopolymer or copolymer, of a methacrylate monomer, having a weight average molecular weight of 20000 to 80000. In this case, upon transfer of the light transparent ink layer onto the object, better fastness or resistance properties, such as better abrasion resistance and lightfastness, can be realized.

For the light transparent ink layer used in the first thermal transfer recording medium, from the viewpoint of transferring the light transparent ink layer onto the light transparent protective layer in the intermediate transfer recording medium with good mutual adhesion between the light transparent protective layer and the light transparent ink layer, a binder as a main component of the light transparent ink layer is preferably highly compatible with a main component of the light transparent protective layer. More specifically, particularly preferably, the light transparent ink layer and the light transparent protective layer contain respective thermoplastic resins, and the thermoplastic resin contained in the light transparent ink layer and the thermoplastic resin contained in the light transparent protective layer are similar to each other in polymer structure and each have an ester linkage in its molecular structure. Polymers, which are similar to each other in structure and have an ester linkage in its molecular structure, include thermoplastic polyester resins, such as aromatic polyester resins and aliphatic or alicyclic polyester resins, vinyl chloride-vinyl acetate copolymers, and homopolymers or copolymers of methacrylate monomers. Preferably, both the thermoplastic resin contained in the light transparent ink layer and the thermoplastic resin contained in the light transparent protective layer are polyester resins, vinyl chloride-vinyl acetate copolymers, homopolymers or copolymers of methacrylate monomers or the like and are similar to each other in polymer structure and have an ester linkage in its molecular structure. The glass transition point and molecular weight of the analogous polymers having an ester linkage in its molecular structure as the thermoplastic resins are not limited so far as these polymers are thermally transferable or coatable onto the substrate.

The transparency or light transmission properties of the light transparent ink layer may be regulated so that, in the final image formed object, a difference in transparency or light transmission properties is provided between the light transparent protective layer and the light transparent ink layer.

Methods usable for regulating the transparency or light transmission properties of the light transparent ink layer include one wherein a conventional colorant is incorporated into the light transparent ink layer, one wherein particles are incorporated into the light transparent ink layer, and one wherein the structure of the light transparent ink layer is brought to a porous network structure.

Materials and methods as described above in connection with the light transparent protective layer may be adopted for the incorporation of the colorant or the particles into the light transparent ink layer or for the formation of the porous network structure in the light transparent ink layer.

Alternatively, the incorporation of the colorant or the particles into the light transparent ink layer or the formation of the porous network structure in the light transparent ink layer may not be adopted, and the level of the transparency or light transmission properties of the light transparent ink layer may be kept very high. In this case, the light transparent image formed by the transfer of the light transparent ink layer is legible by the reflection of light according to the angle of the line of sight to the transferred face. Therefore, the image formed object has alteration preventive properties and a good three-dimensional appearance.

The light transparent ink layer may be formed by adding necessary additives to the above resin for the light transparent ink layer, dissolving the mixture in a suitable organic solvent or dispersing the mixture in an organic solvent or water, coating the solution or dispersion onto a substrate by forming means, such as gravure coating, gravure reverse coating, or roll coating, and drying the coating. The light transparent ink layer may be formed in any desired thickness. Preferably, however, the coverage of the light transparent ink layer is 0.1 to 10 g/m$^2$, more preferably 0.3 to 5 g/m$^2$, on a dry basis.

Backside Layer

In the first thermal transfer recording medium, a backside layer is preferably provided on the substrate in its side remote from the light transparent ink layer from the viewpoints of improving slipperiness on and preventing sticking to heating means, such as a thermal head, used in imagewise heating and transfer of the light transparent ink layer in the first thermal transfer recording medium onto the light transparent protective layer.

The backside layer may be formed of a single resin or a mixture of two or more resins selected from naturally occurring or synthetic resins, for example, cellulosic resins, such as ethylcellulose, hydroxycellulose, hydroxypropylcellulose, methylcellulose, cellulose acetate, cellulose acetate butyrate and nitrocellulose, vinyl resins, such as polyvinyl alcohol, polyvinyl acetate, polyvinyl butyral, polyvinyl acetal, and polyvinyl pyrrolidone, acrylic resins, such as polymethyl methacrylate, polyethyl acrylate, polyacrylamide, and acrylonitrile-styrene copolymer, polyamide resin, polyvinyltoluene resin, coumarone-indene resin, polyester resin, polyurethane resin, and silicone-modified or fluorine-modified urethane. In order to further enhance the heat resistance of the backside layer, preferably, among the above resins, a resin containing a reactive group based on a hydroxyl group is used in combination with polyisocyanate or the like as a crosslinking agent to form a crosslinked resin layer as the backside layer.

In order to impart slidability against the thermal head, a solid or liquid release agent or lubricant may be added to the backside layer to impart heat-resistant slipperiness to the backside layer. Release agents or lubricants include, for example, various waxes, such as polyethylene waxes and paraffin waxes, higher aliphatic alcohols, organopolysiloxanes, anionic surfactants, cationic surfactants, amphoteric surfactants, nonionic surfactants, fluorosurfactants, organic carboxylic acids and derivatives thereof, fluororesins, silicone resins, and fine particles of inorganic compounds such as talc, and silica. The content of the lubricant in the backside layer is about 5 to 50% by weight, preferably about 10 to 30% by weight.

The backside layer may be formed by dissolving or dispersing the above resin, optionally together with a release agent, a lubricant and the like, in a suitable solvent to prepare a coating liquid, coating the coating liquid by a conventional coating method such as gravure coating, roll coating, or wire bar coating, and drying the coating. The coverage of the backside layer is about 0.1 to 10 g/m$^2$ on a dry basis.

In the above-described first thermal transfer recording medium, if necessary, a release layer or a peel layer and an adhesive layer may be additionally provided. Details of these layers are as described above in connection with the intermediate transfer recording medium.

<Second Thermal Transfer Recording Medium>

Next, a second thermal transfer recording medium 8 comprising a substrate 23 and, provided on one side of the substrate 23, a color ink layer 7 comprising a thermoplastic resin and a colorant used in the present invention will be described.

Substrate

The same substrate as used in the conventional thermal transfer recording medium as such may be used as the substrate 23 in the second thermal transfer recording medium, and examples thereof include those as described above in connection with the intermediate transfer recording medium.

Color Ink Layer

The color ink layer 7 provided on the substrate may be formed using a coating liquid containing a thermoplastic resin and a colorant and optionally additives, for example, lubricants such as waxes, dispersants, and anti-settling agents.

Various conventional colorants may be used as the colorant. Among organic or inorganic pigments or dyes, those having good properties as a recording material, for example, those, which have satisfactory color density and are less likely to cause color change and fading upon exposure, for example, to light, heat, and temperature, are preferred as the colorant. Colorants having cyan, magenta, yellow, black and other hues may be properly selected. Pigments having a metallic luster, such as gold color, silver color, or copper color, fluorescent inorganic or organic pigments or dyes, and pigments or dyes of white or intermediate colors such as green, orange, and purple, may also be used.

Among metallic pigments such as gold, silver, copper, zinc, aluminum, chromium and other metal or alloy powders, an aluminum pigment is preferably used because excellent metallic luster and opacifying effect can be realized independently of, for example, the color of the ground of the transfer face of the object. The aluminum pigment may be in a spherical form or a form similar to spheres. However, a platy aluminum pigment is preferred because excellent metallic luster and opacifying effect can be provided. Aluminum used in the color ink layer preferably has an average length of about 1 to 20 $\mu$m and an average thickness of about 0.01 to 5 $\mu$m because the dispersibility in the coating liquid and the metallic luster of the formed image are excellent.

The second thermal transfer recording medium according to the present invention comprises a substrate and a color ink layer provided on one side of the substrate. Color ink layers usable herein are roughly classified into two types, heat-fusion ink layers or sublimable dye ink layers. The heat-fusion ink layer comprises conventional colorant and binder and optionally various additives, for example, mineral oils, vegetable oils, higher fatty acids such as stearic acid, plasticizers, and fillers. Examples of the resin component used as the binder include ethylene-vinyl acetate copolymer, ethylene-acrylic ester copolymer, polyethylene, polystyrene, polypropylene, polybutene, petroleum resin, vinyl chloride resin, vinyl chloride-vinyl acetate copolymer, polyvinyl alcohol, vinylidene chloride resin, methacrylic resin, polyamide, polycarbonate, fluororesin, polyvinylformal, polyvinyl butyral, acetylcellulose, nitrocellulose, polyvinyl acetate, polyisobutylene, ethylcellulose, polyacetal, and polyester.

Examples of the wax component used as the binder include various waxes, for example, microcrystalline wax, carnauba wax, and paraffin wax. Further, other various waxes such as Fischer-Tropsh wax, various types of low-molecular weight polyethylene, Japan wax, beeswax, spermaceti, insect wax, wool wax, shellac wax, candelilla wax, petrolactum, polyester wax, partially modified wax, fatty esters, and fatty amides may also be used.

Preferably, the thermoplastic resin as the binder contained in the heat-fusion ink layer has a structure similar to the binder resin in the thermal transfer layer onto which the ink layer is to be transferred. In this case, high compatibility can be provided. This can realize excellent transferability and fixation of the ink layer onto the thermal transfer layer.

The colorant may be properly selected from the above-described conventional organic or inorganic pigments or dyes. Further, a heat-conductive material may be incorporated as a filler for the binder from the viewpoint of imparting good heat conductivity and heat-fusion transferability to the heat-fusion ink layer. Such fillers include, for example, carbonaceous materials, such as carbon black, and metals and metal compounds such as aluminum, copper, tin oxide, and molybdenum disulfide.

The heat-fusion ink layer may be formed by providing a coating liquid for a heat-fusion ink layer, prepared by mixing the colorant component, binder component, and optionally a solvent component, such as water or an organic solvent, and coating the coating liquid by a conventional method such as hot-melt coating, hot lacquer coating, gravure coating, gravure reverse coating, or roll coating. A formation method using an aqueous or nonaqueous emulsion coating liquid may also be used. The coverage of the heat-fusion ink layer should be determined so as to obtain a balance between necessary print density and heat sensitivity and is preferably in the range of about 0.1 to 10 g/m$^2$, more preferably about 0.5 to 5 g/m$^2$.

The sublimable dye ink layer as the color ink layer is a layer comprising a sublimable dye supported by a binder resin. All dyes commonly used in conventional thermal transfer recording media may be effectively used in the present invention without particular limitation. The following dyes may be mentioned as several examples of preferred dyes. Specifically, MS Red G, Macrolex Red Vioret R, Ceres Red 7B, Samaron Red HBSL, Resolin Red F 3BS and the like may be mentioned as red dyes. Phorone Brilliant Yellow 6 GL, PTY-52, Macrolex Yellow 6G and the like may be mentioned as yellow dyes. Kayaset Blue 714, Waxoline Blue AP-FW, Phorone Brilliant Blue S-R, MS Blue 100 and the like may be mentioned as blue dyes.

Any conventional binder resin (thermoplastic resin) may be used for carrying the above sublimable dyes, and examples of preferred binder resins include: cellulosic resins such as ethylcellulose, hydroxyethylcellulose, ethylhydroxy-cellulose, hydroxypropylcellulose, methylcellulose, cellulose acetate, and cellulose acetate butyrate; vinyl resins such as polyvinyl alcohol, polyvinyl acetate, polyvinyl butyral, polyvinyl acetal, polyvinyl pyrrolidone, and polyacrylamide; and polyesters.

Further, in order to enhance the separability of the color ink layer from the light transparent protective layer as the image receiving side at the time of the formation of a thermally transferred image, a graft copolymer having at least one releasable segment selected from a polysiloxane segment, a carbon fluoride segment, and a long-chain alkyl segment each graft bonded to the main chain of an acrylic, vinyl, polyester, polyurethane, polyamide, or cellulosic resin may be used as the binder resin for carrying the thermally transferable dye.

The use of a dyeable thermoplastic resin binder is required in the light transparent protective layer for receiving the dye in the sublimable dye ink layer. Further, if necessary, a release agent, such as a fluorosurfactant, a silicone oil and/or a cured product thereof, may be incorporated into the sublimable dye ink layer so that, upon heating at the time of the formation of an image, the sublimable dye ink layer and the thermal transfer layer can be smoothly separated from each other without heat fusing. Fluorosurfactants include Fluorad FC-430 and FC-431, manufactured by 3M. Silicone oils include various modified silicone oils and cured products thereof, as described in "Sirikohn Handobukku (Silicone Handbook)" published by The Nikkan Kogyo Shimbun, Ltd. When the formation of a dye image derived from the sublimable dye ink layer on the light transparent protective layer is followed by the transfer and adhesion of the image-formed light transparent protective layer onto an object, the use of a fluorosurfactant and an uncured silicone oil is particularly preferred because they have high adhesion. It is a matter of course that the use of the graft copolymer having a releasable segment as the binder resin in the light transparent protective layer can eliminate the need to add any release agent and can realize high adhesion between the object and the image-formed light transparent protective layer and thus is preferred.

The sublimable dye ink layer may contain, in addition to the dye and the binder resin, optional various conventional additives. The sublimable dye ink layer may be formed by dissolving or dispersing the dye, the binder resin, and additives in a suitable solvent to prepare an ink and coating the ink onto the substrate by the same conventional coating method as described above in connection with the heat-fusion ink layer. The coverage of the sublimable dye ink layer is about 0.1 to 5.0 g/m$^2$, preferably about 0.4 to 2.0 g/m$^2$.

In the second thermal transfer recording medium provided with a heat-fusion ink layer as the thermal transfer color ink layer used in the present invention, the thermal transfer color ink layer is provided on the substrate. The thermal transfer ink layer may be provided through a release layer or a peel layer on the substrate to further facilitate the separation of the thermal transfer ink layer from the substrate upon heating. Further, an adhesive layer, an intermediate layer or the like may be provided on the thermal transfer ink layer in the second thermal transfer recording medium.

On the other hand, in the case of the second thermal transfer recording medium provided with a sublimable dye ink layer as the color ink layer, the color ink layer is provided on the substrate. In this case, an intermediate layer, such as a primer layer, may be provided between the substrate and the color ink layer to enhance the adhesion between the substrate and the color ink layer.

The same material and formation method as used in the release layer, the peel layer, and the adhesive layer in the intermediate transfer recording medium may be applied to the release layer, the peel layer, and the adhesive layer in the second thermal transfer recording medium. The intermediate layer may be a conventional one.

The thickness of the light transparent image is preferably 0.3 to 5.0 $\mu$m. When the thickness of the light transparent image is less than 0.3 $\mu$m, the visibility is disadvantageously deteriorated. On the other hand, when the thickness of the light transparent image exceeds 5.0 $\mu$m, the transferability is disadvantageously deteriorated.

In the method for image formation according to the present invention, means for image formation by imagewise heating used in thermally transferring the light transparent ink layer in the first thermal transfer recording medium onto the light transparent protective layer in the intermediate transfer recording medium to form a light transparent image and used in thermally transferring the color ink layer in the second thermal transfer recording medium onto the light transparent protective layer in the intermediate transfer recording medium to form a color image may be conventional thermal energy impartation means for thermal transfer, such as heating by means of a thermal head or laser beam irradiation.

Examples of means for the transfer, onto an object, of the light transparent protective layer, on which the light transparent image derived from the light transparent ink layer and the color image derived from the color ink layer have been formed, include a thermal head usable in the formation of a transferred image, a line heater, a heat roll, and a hot stamp.

In the present invention, in order that the finally obtained images in the image formed object are oriented in a proper direction, images (light transparent image and color image) having a mirror relationship with the final images should be formed in the light transparent protective layer provided on the intermediate transfer recording medium.

The object, on which images are formed by the retransfer of the image-formed light transparent protective layer in the intermediate transfer recording medium, is not particularly limited. Examples thereof include sheets or three-dimensional molded products of plain paper, wood free paper, tracing paper, various plastics or the like. The object may be in the form of any of cards, postal cards, passports, letter papers or writing pads, report pads, notebooks, catalogs, cups, cases, building materials, panels, electronic components, such as telephones, radios, and televisions, and rechargeable batteries. According to the method for image formation according to the present invention, recording can be carried out even on objects formed of a sparingly adhesive plastic material, particularly polycarbonate resin, polypropylene resin, polyethylene resin, polyethylene terephthalate resin, polymethyl methacrylate, etc. with excellent transferability and adhesion.

EXAMPLES

The following examples and comparative examples further illustrate the present invention, but should not be construed as limiting the present invention. In the following description, "parts" or "%" is by weight unless otherwise specified.

Preparation of Intermediate Transfer Recording Media 1 to 25

Intermediate transfer recording media 1 to 25 are prepared. Conditions for the formation of each layer constituting the intermediate transfer recording media are shown in Table 5 below. Specifically, a release layer, a peel layer, and a light transparent protective layer are formed in that order on a substrate shown in Table 5 under conditions shown in Table 5. The composition of the release layer in each intermediate transfer recording medium is as shown in Table 5. Details of resins used in the release layer are as shown in Table 2.

The composition of the peel layer in each intermediate transfer recording medium is as shown in Table 5. Details of resins used in the peel layer are as shown in Table 3.

The composition of the light transparent protective layer in each intermediate transfer recording medium is as shown in Table 5. Details of resins used in the light transparent protective layer are as shown in Table 1.

TABLE 1

Polyester resin for light transparent protective layer and light transparent ink layer

| | Tg | Number average molecular weight | Carboxylic acid component | Alcohol component |
|---|---|---|---|---|
| Resin A-1 | 65° C. | 20000 | Terephthalic acid/isophthalic acid | Ethylene glycol/neopentyl glycol |
| Resin A-2 | 52° C. | 4000 | Terephthalic acid/isophthalic acid | Ethylene glycol/neopentyl glycol |
| Resin A-3 | 75° C. | 15000 | Terephthalic acid/isophthalic acid | Ethylene glycol/neopentyl glycol/tricyclodecane glycol |
| Resin A-4 | 80° C. | 8000 | Terephthalic acid/isophthalic acid | Ethylene glycol/tricyclodecane glycol |
| Resin A-5 | 95° C. | 5000 | Terephthalic acid/isophthalic acid/trimellitic acid | Ethylene glycol/tricyclodecane glycol |
| Resin A-6 | 20° C. | 10000 | Terephthalic acid/isophthalic acid/sebacic acid | Ethylene glycol/neopentyl glycol |

Methacrylate copolyer/homopolymer for light transparent protective layer and light transparent ink layer

| | Tg | Weight average molecular weight | Methacrylate component |
|---|---|---|---|
| Resin B-1 | 105° C. | 40000 | Methyl methacrylate |
| Resin B-2 | 105° C. | 25000 | Methyl methacrylate |
| Resin B-3 | 75° C. | 30000 | Methyl methacrylate/n-butyl methacrylate |
| Resin B-4 | 50° C. | 50000 | Methyl methacrylate/n-butyl methacrylate |
| Resin B-5 | 85° C. | 35000 | Methyl methacrylate/iso-butyl methacrylate |
| Resin B-6 | 105° C. | 95000 | Methyl methacrylate |

Vinyl chloride-vinyl acetate copolymer for light transparent protective layer and light transparent ink layer

| | Tg | Average degree of polymerization | Constituents | Tradename |
|---|---|---|---|---|
| Resin C-1 | 65° C. | 430 | Vinyl chloride/vinyl acetate | — |
| Resin C-2 | 65° C. | 320 | Vinyl chloride/vinyl acetate | — |
| Resin C-3 | 52° C. | 200 | Vinyl chloride/vinyl acetate | — |
| Resin C-4 | 70° C. | 300 | Vinyl chloride/vinyl acetate/vinyl alcohol | — |
| Resin C-5 | — | — | Vinyl chloride/vinyl acetate/maleic acid | TF-120 (Denki Kagaku Kogya K. K.) |
| Resin C-6 | — | — | Vinyl chloride/vinyl acetate/vinyl alcohol | #1000GSK (Denki Kagaku Kogya K. K.) |

TABLE 2

Water-soluble polyvinyl acetal for release layer

| Resin | Degree of acetalization | Tradename | Manufacturer |
|---|---|---|---|
| Resin D-1 | 5–11 mol % | KX-1 | Sekisui Chemical Co., Ltd. |
| Resin D-2 | 6–12 mol % | KW-1 | Sekisui Chemical Co., Ltd. |

Polyvinyl alcohol for release layer

| Resin | Degree of saponification | Tradename | Manufacturer |
|---|---|---|---|
| Resin E-1 | 99.0–100 mol % | NM-11 | Nippon Synthetic Chemical Industry Co., Ltd. |
| Resin E-2 | 98.5–99.4 mol % | NH-20 | Nippon Synthetic Chemical Industry Co., Ltd. |
| Resin E-3 | 97.0–98.5 mol % | AH-17 | Nippon Synthetic Chemical Industry Co., Ltd. |
| Resin E-4 | 86.5–89.0 mol % | GH-14 | Nippon Synthetic Chemical Industry Co., Ltd. |
| Resin E-5 | 76.7–79.3 mol % | KM-11 | Nippon Synthetic Chemical Industry Co., Ltd. |

TABLE 3

Methacrylate copolymer/homopolymer for peel layer

| Resin | Tg | Weight average molecular weight | Methacrylate component |
|---|---|---|---|
| Resin F-1 | 105° C. | 40000 | Methyl methacrylate |
| Resin F-2 | 105° C. | 25000 | Methyl methacrylate |

TABLE 3-continued

Methacrylate copolymer/homopolymer for peel layer

| Resin | Tg | Weight average molecular weight | Methacrylate component |
|---|---|---|---|
| Resin F-3 | 75° C. | 30000 | Methyl methacrylate/n-butyl methacrylate |
| Resin F-4 | 50° C. | 50000 | Methyl methacrylate/n-butyl methacrylate |
| Resin F-5 | 85° C. | 35000 | Methyl methacrylate/iso-butyl methacrylate |
| Resin F-6 | 105° C. | 95000 | Methyl methacrylate |

TABLE 4

Composition of backside layer

| | |
|---|---|
| Styrene-acrylonitrile copolymer | 45 pts. wt. |
| Linear saturated polyester | 2 pts. wt. |
| Zinc stearyl phosphate | 21 pts. wt. |
| Powder of crosslinked urea resin | 21 pts. wt. |
| Powder of crosslinked melamine resin | 11 pts. wt. |

TABLE 5

| Intermediate transfer recording media | Backside layer | | Release layer | | Peel layer | | Light transparent protective layer | |
|---|---|---|---|---|---|---|---|---|
| | Coverage | Substrate | Composition | Coverage | Composition | Coverage | Composition | Coverage |
| Intermediate transfer recording medium 1 | 0.2 g/m$^2$ | PET film with one side subjected to corona treatment (12 μm) | Resin D-1 | 0.2 g/m$^2$ | None | — | Resin A-5 = 100 | 4.0 g/m$^2$ |
| Intermediate transfer recording medium 2 | 0.2 g/m$^2$ | PET film with one side subjected to corona treatment (12 μm) | Resin D-1 | 0.2 g/m$^2$ | None | — | Resin A-1/resin A-5 = 50/50 | 7.0 g/m$^2$ |
| Intermediate transfer recording medium 3 | 0.2 g/m$^2$ | PET film with one side subjected to corona treatment (12 μm) | Resin D-1 | 0.2 g/m$^2$ | None | — | Resin A-1/resin A-5/carnauba wax = 48/48/4 | 6.0 g/m$^2$ |
| Intermediate transfer recording medium 4 | 0.2 g/m$^2$ | PET film with one side subjected to corona treatment (12 μm) | Resin D-1 | 0.2 g/m$^2$ | None | — | Resin A-1/resin A-5/silica = 49/49/2 | 6.0 g/m$^2$ |
| Intermediate transfer recording medium 5 | 0.2 g/m$^2$ | PET film with one side subjected to corona treatment (12 μm) | Resin D-2 | 0.5 g/m$^2$ | None | — | Resin A-3/resin A-5 = 50/50 | 6.0 g/m$^2$ |
| Intermediate transfer recording medium 6 | 0.2 g/m$^2$ | PET film with one side subjected to corona treatment (12 μm) | Resin D-2 | 0.5 g/m$^2$ | Resin F-1/ carnauba wax = 98/2 | 1.0 g/m$^2$ | Resin A-1/ carnauba wax = 97/3 | 4.0 g/m$^2$ |
| Intermediate transfer recording medium 7 | 0.2 g/m$^2$ | PET film with one side subjected to corona treatment (12 μm) | None | — | Resin F-3/ polyethylene wax = 98/2 | 2.0 g/m$^2$ | Resin A-2/resin A-3 = 40/60 | 5.0 g/m$^2$ |
| Intermediate transfer recording medium 8 | 0.2 g/m$^2$ | PET film with one side subjected to corona treatment (12 μm) | Resin D-2 | 0.1 g/m$^2$ | Resin F-5/ polyethylene wax = 98/2 | 1.0 g/m$^2$ | Resin A-4 carnauba wax = 98/2 | 5.0 g/m$^2$ |
| Intermediate transfer recording medium 9 | 0.2 g/m$^2$ | PET film with one side subjected to corona treatment (12 μm) | Resin E-1 | 0.2 g/m$^2$ | None | — | Resin A-1/resin A-5 = 60/40 | 5.0 g/m$^2$ |
| Intermediate transfer recording medium 10 | 0.2 g/m$^2$ | PET film with one side subjected to corona treatment (12 μm) | Resin E-2 | 0.2 g/m$^2$ | None | — | Resin A-1/resin A-5 = 60/40 | 5.0 g/m$^2$ |
| Intermediate transfer recording medium 11 | 0.2 g/m$^2$ | PET film with one side subjected to corona treatment (12 μm) | Resin E-3 | 0.2 g/m$^2$ | None | — | Resin A-1/resin A-5 = 60/40 | 5.0 g/m$^2$ |
| Intermediate transfer recording medium 12 | 0.2 g/m$^2$ | PET film with one side subjected to corona treatment (12 μm) | Resin E-4 | 0.2 g/m$^2$ | None | — | Resin A-1/resin A-5 = 60/40 | 5.0 g/m$^2$ |
| Intermediate transfer recording medium 13 | 0.2 g/m$^2$ | PET film with one side subjected to corona treatment (12 μm) | Resin E-5 | 0.2 g/m$^2$ | None | — | Resin A-1/resin A-5 = 60/40 | 5.0 g/m$^2$ |
| Intermediate transfer recording medium 14 | 0.2 g/m$^2$ | PET film with one side subjected to corona treatment (12 μm) | Resin D-1 | 0.2 g/m$^2$ | None | — | Resin B-1/ carnauba wax = 98/2 | 6.0 g/m$^2$ |
| Intermediate transfer recording medium 15 | 0.2 g/m$^2$ | PET film with one side subjected to corona treatment (12 μm) | Resin D-1 | 0.2 g/m$^2$ | None | — | Resin B-2/ carnauba wax = 98/2 | 6.0 g/m$^2$ |
| Intermediate transfer recording medium 16 | 0.2 g/m$^2$ | PET film with one side subjected to corona treatment (12 μm) | Resin D-1 | 0.2 g/m$^2$ | None | — | Resin B-3/ carnauba wax = 98/2 | 6.0 g/m$^2$ |
| Intermediate transfer recording medium 17 | 0.2 g/m$^2$ | PET film with one side subjected to corona treatment (12 μm) | Resin D-1 | 0.2 g/m$^2$ | None | — | Resin B-4/ carnauba wax = 98/2 | 6.0 g/m$^2$ |
| Intermediate transfer recording medium 18 | 0.2 g/m$^2$ | PET film with one side subjected to corona treatment (12 μm) | Resin D-1 | 0.2 g/m$^2$ | None | — | Resin B-5/ carnauba wax = 98/2 | 6.0 g/m$^2$ |
| Intermediate transfer recording medium 19 | 0.2 g/m$^2$ | Untreated PET film (12 μm) | None | — | None | — | Resin B-3/ carnauba wax = 98/2 | 6.0 g/m$^2$ |
| Intermediate transfer recording medium 20 | 0.2 g/m$^2$ | Untreated PET film (12 μm) | None | — | Resin F-3/ polyethylene wax = 98/2 | 2.0 g/m$^2$ | Resin B-4 = 100 | 6.0 g/m$^2$ |
| Intermediate transfer recording medium 21 | 0.2 g/m$^2$ | Untreated PET film (12 μm) | None | — | Resin F-3/ polytheylene wax = 98/2 | 2.0 g/m$^2$ | Resin B-3/resin B-4 = 70/30 | 6.0 g/m$^2$ |
| Intermediate transfer recording medium 22 | 0.2 g/m$^2$ | PET film with one side subjected to corona treatment (12 μm) | Resin D-1 | 0.2 g/m$^2$ | None | — | Resin C-1/resin C-3 = 50/50 | 6.0 g/m$^2$ |
| Intermediate transfer recording medium 23 | 0.2 g/m$^2$ | PET film with one side subjected to corona treatment (12 μm) | Resin D-1 | 0.2 g/m$^2$ | None | — | Resin C-2/resin C-3 = 50/50 | 6.0 g/m$^2$ |

TABLE 5-continued

| Intermediate transfer recording media | | | | | | | | |
|---|---|---|---|---|---|---|---|---|
| | Backside layer | | Release layer | | Peel layer | | Light transparent protective layer | |
| | Coverage | Substrate | Composition | Coverage | Composition | Coverage | Composition | Coverage |
| Intermediate transfer recording medium 24 | 0.2 g/m$^2$ | PET film with one side subjected to corona treatment (12 μm) | Resin D-1 | 0.2 g/m$^2$ | None | — | Resin C-4/resin C-3 = 50/50 | 6.0 g/m$^2$ |
| Intermediate transfer recording medium 25 | 0.2 g/m$^2$ | PET film with one side subjected to corona treatment (9 μm) | Resin D-1 | 0.2 g/m$^2$ | None | — | Resin C-1/resin C-3/epoxymodified silicone = 70/29/1 | 3.0 g/m$^2$ |

Preparation of Thermal Transfer Recording Media 1-1 to 1-10

Thermal transfer recording media 1-1 to 1-10 are prepared. Conditions for the formation of each layer constituting the thermal transfer recording media are shown in Table 6 below. Specifically, a backside layer having a composition shown in Table 4 is formed on one side of a substrate shown in Table 6 by coating at a coverage of 0.2 g/m$^2$ on a solid basis. A release layer, a peel layer, and a light transparent ink layer are formed in that order on the other side of the substrate under conditions specified in Table 6. The composition of the release layer in each thermal transfer recording medium is as shown in Table 6. Details of resins used in the release layer are as shown in Table 2.

The composition of the peel layer in each thermal transfer recording medium is as shown in Table 6. Details of resins used in the peel layer are as shown in Table 3.

The composition of the light transparent ink layer in each thermal transfer recording medium is as shown in Table 6. Details of resins used in the light transparent ink layer are as shown in Table 1.

TABLE 6

| Thermal transfer recording medium 1 | | | | | | | | |
|---|---|---|---|---|---|---|---|---|
| | Backside layer | | Release layer | | Peel layer | | Light transparent link layer | |
| | Coverage | Substrate | Composition | Coverage | Composition | Coverage | Composition | Coverage |
| Thermal transfer recording medium 1-1 | 0.2 g/m$^2$ | PET film with one side subjected to corona treatment (12 μm) | Resin D-1 | 0.2 g/m$^2$ | None | — | Resin A-6 = 100 | 4.0 g/m$^2$ |
| Thermal transfer recording medium 1-2 | 0.2 g/m$^2$ | PET film with one side subjected to corona treatment (6 μm) | Resin D-1 | 0.2 g/m$^2$ | None | — | Resin A-5 = 100 | 0.1 g/m$^2$ |
| Thermal transfer recording medium 1-3 | 0.2 g/m$^2$ | PET film with one side subjected to corona treatment (6 μm) | Resin D-1 | 0.2 g/m$^2$ | None | — | Resin A-5 = 100 | 1.5 g/m$^2$ |
| Thermal transfer recording medium 1-4 | 0.2 g/m$^2$ | PET film with one side subjected to corona treatment (12 μm) | Resin D-1 | 0.2 g/m$^2$ | None | — | Resin B-6/carnauba wax = 98/2 | 6.0 g/m$^2$ |
| Thermal transfer recording medium 1-5 | 0.2 g/m$^2$ | PET film with one side subjected to corona treatment (6 μm) | Resin D-1 | 0.2 g/m$^2$ | None | — | Resin B-3/carnauba wax = 98/2 | 0.3 g/m$^2$ |
| Thermal transfer recording medium 1-6 | 0.2 g/m$^2$ | PET film with one side subjected to corona treatment (6 μm) | Resin D-1 | 0.2 g/m$^2$ | None | — | Resin B-3/carnauba wax = 98/2 | 2.5 g/m$^2$ |
| Thermal transfer recording medium 1-7 | 0.2 g/m$^2$ | PET film with one side subjected to corona treatment (9 μm) | Resin D-1 | 0.2 g/m$^2$ | None | — | Resin C-1/resin C-3/ epoxy-modified silicone = 70/29/1 | 3.0 g/m$^2$ |
| Thermal transfer recording medium 1-8 | 0.2 g/m$^2$ | PET film with one side subjected to corona treatment (6 μm) | Resin D-1 | 0.2 g/m$^2$ | None | — | Resin C-1/resin C-3 = 50/50 | 1.2 g/m$^2$ |
| Thermal transfer recording medium 1-9 | 0.2 g/m$^2$ | PET film with one side subjected to corona treatment (6 μm) | Resin D-1 | 0.2 g/m$^2$ | None | — | Resin A-1/resin A-5/ silica = 47/47/6 | 1.2 g/m$^2$ |
| Thermal transfer recording medium 1-10 | 0.2 g/m$^2$ | PET film with one side subjected to corona treatment (6 μm) | Resin D-1 | 0.2 g/m$^2$ | None | — | Resin A-5/resin A-6 = 75/25 (*1) | 1.2 g/m$^2$ |

*1: Toluene/methyl ethyl ketone/n-butyl alcohol = 5/45/50 was used as a diluent solvent.

Preparation of Thermal Transfer Recording Media 2-1 to 2-5

Thermal transfer recording media 2-1 to 2-5 for color image formation were prepared. Conditions for the formation of each layer constituting the thermal transfer recording media are shown in Table 7.

TABLE 7

| | Thermal transfer recording medium 2 | | | | | | | | |
|---|---|---|---|---|---|---|---|---|---|
| | Coverage of | | Composition of color ink layer | | | | | | Coverage |
| | backside layer | Substrate | Colorant | Weight ratio | Binder | Weight ratio | Other ingredient | Weight ratio | of color ink layer |
| Thermal transfer recording medium 2-1 | 0.2 g/m$^2$ | Untreated PET film (4.5 $\mu$m) | Aluminum pigment | 35 | Polyester resin (resin A-5) | 65 | — | — | 1.0 g/m$^2$ |
| Thermal transfer recording medium 2-2 | 0.2 g/m$^2$ | Untreated PET film (4.5 $\mu$m) | Carbon black | 35 | Methacrylate copolymer (resin B-4) | 65 | — | — | 1.0 g/m$^2$ |
| Thermal transfer recording medium 2-3 | 0.2 g/m$^2$ | PET film with one side subjected to corona treatment (4.5 $\mu$m) | Yellow dye (Macrolex Yellow 6G) | 40 | Polyvinyl acetal resin (KS-5; Sekisui Chemical Co., Ltd.) | 59.9 | Epoxy-modified silicone | 0.1 | 1.0 g/m$^2$ |
| Thermal transfer recording medium 2-4 | 0.2 g/m$^2$ | PET film with one side subjected to corona treatment (4.5 $\mu$m) | Magenta dye (MS Red G) | 40 | Polyvinyl acetal resin (KS-5; Sekisui Chemical Co., Ltd.) | 59.9 | Epoxy-modified silicone | 0.1 | 1.0 g/m$^2$ |
| Thermal transfer recording medium 2-5 | 0.2 g/m$^2$ | PET film with one side subjected to corona treatment (4.5 $\mu$m) | Cyan dye (Phorone Brilliant Blue S-R) | 40 | Polyvinyl acetal resin (KS-5; Sekisui Chemical Co., Ltd.) | 59.9 | Epoxy-modified silicone | 0.1 | 1.0 g/m$^2$ |

Object

A 200 $\mu$m-thick white flexible vinyl chloride sheet or a 200 $\mu$m-thick black polycarbonate sheet was provided as an object for the evaluation of image formed objects.

Examples 1 to 27 and Comparative Examples 1 to 4

In combinations specified in Table 8, a thermal transfer recording medium 1 is put on top of an intermediate transfer recording medium so that the light transparent ink layer in the thermal transfer recording medium 1 faces the light transparent protective layer in the intermediate transfer recording medium. The assembly is imagewise heated by a thermal head from the backside of the thermal transfer recording medium 1 to imagewise transfer the light transparent ink layer in the thermal transfer recording medium 1 onto the light transparent protective layer in the intermediate transfer recording medium, whereby a light transparent image is formed on the light transparent protective layer.

In the intermediate transfer recording medium having the light transparent protective layer with the light transparent image formed thereon, the distance between the top of the convex portion and the top of the light transparent protective layer was measured and indicated as the thickness of the convex in Table 8.

In forming the light transparent image as the convex, heating was carried out by a thermal head under the following printing conditions.

In this case, a printer for evaluation was used under printing conditions of line speed 2.8 msec/line, pulse duty 80%, resolution of thermal head 300 dpi, resistance value of thermal head 1600 Ω, and applied voltage 17.5 V.

TABLE 8

| | Results of evaluation | | | | | | | |
|---|---|---|---|---|---|---|---|---|
| | Thermal transfer recording medium 1 | Intermediate transfer recording medium | Thermal transfer recording medium 2 | Object | Visibility of light transparent image | Transferability | Abrasion resistance | Thickness of convex portion |
| Ex.1 | Thermal transfer recording medium 1-3 | Intermediate transfer recording medium 1 | Thermal transfer recording medium 2-1 | Polycarbonate sheet | ○ | ○ | ○ | 1.7 $\mu$m |
| Ex.2 | Thermal transfer recording medium 1-3 | Intermediate transfer recording medium 2 | Thermal transfer recording medium 2-1 | Polycarbonate sheet | ○ | ○ | ○ | 1.7 $\mu$m |
| Ex.3 | Thermal transfer recording medium 1-3 | Intermediate transfer recording medium 3 | Thermal transfer recording medium 2-1 | Polycarbonate sheet | ○ | ○ | ○ | 1.7 $\mu$m |
| Ex.4 | Thermal transfer recording medium 1-3 | Intermediate transfer recording medium 4 | Thermal transfer recording medium 2-1 | Polycarbonate sheet | ○ | ○ | ○ | 1.7 $\mu$m |
| Ex.5 | Thermal transfer recording medium 1-3 | Intermediate transfer recording medium 5 | Thermal transfer recording medium 2-1 | Polycarbonate sheet | ○ | ○ | ○ | 1.7 $\mu$m |
| Ex.6 | Thermal transfer recording medium 1-3 | Intermediate transfer recording medium 6 | Thermal transfer recording medium 2-1 | Polycarbonate sheet | ○ | ○ | ○ | 1.7 $\mu$m |
| Ex.7 | Thermal transfer recording medium 1-3 | Intermediate transfer recording medium 7 | Thermal transfer recording medium 2-1 | Polycarbonate sheet | ○ | ○ | ○ | 1.7 $\mu$m |
| Ex.8 | Thermal transfer recording medium 1-3 | Intermediate transfer recording medium 8 | Thermal transfer recording medium 2-1 | Polycarbonate sheet | ○ | ○ | ○ | 1.7 $\mu$m |
| Ex.9 | Thermal transfer recording medium 1-3 | Intermediate transfer recording medium 9 | Thermal transfer recording medium 2-1 | Polycarbonate sheet | ○ | ○ | ○ | 1.7 $\mu$m |

TABLE 8-continued

| | Thermal transfer recording medium 1 | Intermediate transfer recording medium | Thermal transfer recording medium 2 | Object | Results of evaluation: Visibility of light transparent image | Trans fera-bility | Abrasion resistance | Thickness of convex portion |
|---|---|---|---|---|---|---|---|---|
| Ex.10 | Thermal transfer recording medium 1-3 | Intermediate transfer recording medium 10 | Thermal transfer recording medium 2-1 | Polycarbonate sheet | ○ | ○ | ○ | 1.7 μm |
| Ex.11 | Thermal transfer recording medium 1-3 | Intermediate transfer recording medium 11 | Thermal transfer recording medium 2-1 | Polycarbonate sheet | ○ | ○ | ○ | 1.7 μm |
| Ex.12 | Thermal transfer recording medium 1-3 | Intermediate transfer recording medium 12 | Thermal transfer recording medium 2-1 | Polycarbonate sheet | ○ | ○ | ○ | 1.7 μm |
| Ex.13 | Thermal transfer recording medium 1-3 | Intermediate transfer recording medium 13 | Thermal transfer recording medium 2-1 | Polycarbonate sheet | ○ | ○ | ○ | 1.7 μm |
| Ex.14 | Thermal transfer recording medium 1-6 | Intermediate transfer recording medium 14 | Thermal transfer recording medium 2-2 | Polyvinyl chloride sheet | ○ | ○ | ○ | 2.7 μm |
| Ex.15 | Thermal transfer recording medium 1-6 | Intermediate transfer recording medium 15 | Thermal transfer recording medium 2-2 | Polyvinyl chloride sheet | ○ | ○ | ○ | 2.7 μm |
| Ex.16 | Thermal transfer recording medium 1-6 | Intermediate transfer recording medium 16 | Thermal transfer recording medium 2-2 | Polyvinyl chloride sheet | ○ | ○ | ○ | 2.7 μm |
| Ex.17 | Thermal transfer recording medium 1-6 | Intermediate transfer recording medium 17 | Thermal transfer recording medium 2-2 | Polyvinyl chloride sheet | ○ | ○ | ○ | 2.7 μm |
| Ex.18 | Thermal transfer recording medium 1-6 | Intermediate transfer recording medium 18 | Thermal transfer recording medium 2-2 | Polyvinyl chloride sheet | ○ | ○ | ○ | 2.7 μm |
| Ex.19 | Thermal transfer recording medium 1-6 | Intermediate transfer recording medium 19 | Thermal transfer recording medium 2-2 | Polyvinyl chloride sheet | ○ | ○ | ○ | 2.7 μm |
| Ex.20 | Thermal transfer recording medium 1-6 | Intermediate transfer recording medium 20 | Thermal transfer recording medium 2-2 | Polyvinyl chloride sheet | ○ | ○ | ○ | 2.7 μm |
| Ex.21 | Thermal transfer recording medium 1-6 | Intermediate transfer recording medium 21 | Thermal transfer recording medium 2-2 | Polyvinyl chloride sheet | ○ | ○ | ○ | 2.7 μm |
| Ex.22 | Thermal transfer recording medium 1-8 | Intermediate transfer recording medium 22 | Thermal transfer recording medium 2-2 | Polyvinyl chloride sheet | ○ | ○ | ○ | 1.3 μm |
| Ex.23 | Thermal transfer recording medium 1-8 | Intermediate transfer recording medium 23 | Thermal transfer recording medium 2-2 | Polyvinyl chloride sheet | ○ | ○ | ○ | 1.3 μm |
| Ex.24 | Thermal transfer recording medium 1-8 | Intermediate transfer recording medium 24 | Thermal transfer recording media 2-3, 4, and 5 | Polyvinyl chloride sheet | ○ | ○ | ○ | 1.3 μm |
| Ex.25 | Thermal transfer recording medium 1-7 | Intermediate transfer recording medium 25 | Thermal transfer recording media 2-3, 4, and 5 | Polyvinyl chloride sheet | ○ | ○ | ○ | 3.3 μm |
| Ex.26 | Thermal transfer recording medium 1-9 | Intermediate transfer recording medium 1 | Thermal transfer recording medium 2-1 | Polycarbonate sheet | ◎ | ○ | ○ | 1.0 μm |
| Ex.27 | Thermal transfer recording medium 1-10 | Intermediate transfer recording medium 22 | Thermal transfer recording medium 2-2 | Polyvinyl chloride sheet | ◎ | ○ | ○ | 1.0 μm |
| Comp. Ex. 1 | Thermal transfer recording medium 1-2 | Intermediate transfer recording medium 1 | Thermal transfer recording medium 2-1 | Polycarbonate sheet | × | ○ | ○ | 0.1 μm |
| Comp. Ex. 2 | Thermal transfer recording medium 1-1 | Same as intermediate transfer recording medium 1 except for change of resin A-5 to resin A-6 | Transfer transfer recording medium 2-1 | Polycarbonate sheet | ○ | ○ | × | 4.3 μm |
| Comp. Ex. 3 | Thermal transfer recording medium 1-4 | Same as intermediate transfer recording medium 14 except for change of resin B-1 to resin B-6 | Thermal transfer recording medium 2-1 | Polyvinyl chloride sheet | ○ | × | ○ | 6.5 μm |
| Comp. Ex. 4 | Thermal transfer recording medium 1-5 | Intermediate transfer recording medium 18 | Thermal transfer recording medium 2-2 | Polyvinyl chloride sheet | × | ○ | ○ | 0.3 μm |

The intermediate transfer recording medium provided with the light transparent image prepared by the above method and the thermal transfer recording medium 2 are put on top of each other so that the light transparent protective layer in the intermediate transfer recording medium faces the color ink layer in the thermal transfer recording medium 2. The assembly is imagewise heated by a thermal head from the backside of the thermal transfer recording medium 2 to imagewise transfer the colorant alone or a combination of the colorant with the binder onto the light transparent protective layer in the intermediate transfer recording medium, whereby a color image is formed on the light transparent protective layer in the intermediate transfer recording medium. Thereafter, an object and the intermediate transfer recording medium with the light transparent image and the color image formed on its light transparent protective layer are put on top of each other so that the object faces the light transparent image and the color image. In this state, the whole assembly is heated from the backside of the intermediate transfer recording medium by means of a heat roll covered with rubber heated at 180° C. to transfer the whole area of the light transparent protective layer, with the light transparent image and the color image formed thereon, in the intermediate transfer recording medium, whereby a color image and a light transparent image are formed on the object.

In this case, the color image was printed under the same conditions as used in the preparation of the light transparent image.

In Examples 1 to 27 and Comparative Examples 1 to 4, the intermediate transfer recording medium provided in each example, the thermal transfer recording medium 1 and thermal transfer recording medium 2, and the object were used in combination as specified in Table 8. Further, the color image and the light transparent image were formed on the object.

The objects with the color image and the light transparent image formed thereon were evaluated as follows.

Visibility of Light Transparent Image

The light transparent ink layer was transferred as a light transparent image in the form of a letter "ABC" having a size of 7 point onto the light transparent protective layer in the intermediate transfer recording medium. A light transparent image and a color image were formed on the object by the above method using this intermediate transfer recording medium, and the legibility of the letter "ABC" was evaluated.

Transferability

The object with a light transparent image and a color image formed thereon by the above method was visually inspected for the following items to evaluate the transferability.

Transfer failure (a part of the light transparent protective layer in the intermediate transfer recording medium was not transferred)

Tailing (the light transparent protective layer transferred onto the object was projected from the end of the object)

Abrasion Resistance

The object with a light transparent image and a color image formed thereon was subjected to a 200-revolution abrasion resistance test with a TABER tester using a truck wheel CS-10F under a load of 500 gf, and the object was then inspected for the loss of the color image and the light transparent image.

The results of evaluation for the examples and the comparative examples were as shown in Table 8.

For the visibility of the light transparent image, as compared with the image formed objects prepared in Examples 1 to 25, the image formed objects prepared in Examples 26 and 27 were slightly opaque and translucent in their light transparent image portion and, since the light transparent protective layer in its portion adjacent to the image portion was transparent, the light transmittance of the light transparent image portion was different from the light transmittance of the light transparent protective layer in its portion adjacent to the image portion, rendering the light transparent image portion conspicuous.

For Comparative Examples 1 and 4 wherein the thickness of the light transparent image was 0.1 to 0.3 $\mu$m and thus was smaller than the thickness 1.0 $\mu$m of the color image, the visibility of the light transparent image was poor. For Comparative Example 2 wherein the binder in the light transparent ink layer for the formation of the light transparent protective layer and the light transparent image had a low glass transition point of 20° C., the image formed object had low abrasion resistance. For Comparative Example 3 wherein the binder in the light transparent ink layer for the formation of the light transparent protective layer and the light transparent image had a high number average molecular weight of 95000, the transferability was poor.

As is apparent from the foregoing description, in the method for image formation according to the present invention, an intermediate transfer recording medium comprising a substrate and a light transparent protective layer provided on one side of the substrate, and a first thermal transfer recording medium comprising a substrate and a light transparent ink layer provided on one side of the substrate are first provided. The intermediate transfer recording medium and the first thermal transfer recording medium are put on top of each other so that the light transparent protective layer in the intermediate transfer recording medium faces the light transparent ink layer in the first thermal transfer recording medium. The assembly is imagewise heated to form a light transparent image on the light transparent protective layer in the intermediate transfer recording medium. The intermediate transfer recording medium with the light transparent image formed thereon is then put on top of a second thermal transfer recording medium comprising a substrate and, provided on one side of the substrate, a color ink layer comprising a thermoplastic resin and a colorant so that the light transparent protective layer on its light transparent image-formed side in the intermediate transfer recording medium faces the color ink layer in the second thermal transfer recording medium. The assembly is imagewise heated to transfer the color ink layer or the colorant contained in the color ink layer onto the light transparent protective layer on its light transparent image-formed side in the intermediate transfer recording medium, whereby a color image is formed on the light transparent protective layer. An object is then put on top of the intermediate transfer recording medium with the light transparent image and the color image formed on its light transparent protective layer so that the light transparent image and the color image face the object. The whole assembly is heated to form a color image, a light transparent image and a light transparent protective layer on the object.

In the image formed object thus obtained, the image formed by the transfer of the color ink layer is protected by the light transparent protective layer and, further, by virtue of a combination thereof with the light transparent image, has excellent fastness or resistance properties such as excellent abrasion resistance, lightfastness, and alteration preventive properties. Further, for example, according to the angle of the line of sight to the image-recorded face in the image formed object, the convex portion in the light transparent image transferred to the object is legible by the reflection of light.

Further, a protective layer having on its surface a color image and a light transparent image can be formed on an object by single transfer using an intermediate transfer recording medium comprising a light transparent protective layer having on its surface a color image, formed by the transfer of a color ink layer, and a light transparent image formed by the transfer of a light transparent ink layer. Therefore, the damage to the object by the transfer operation is less likely to occur, and a deterioration in image quality and an increase in production cost can be suppressed.

What is claimed is:

1. A method for image formation, comprising the steps of:

providing an intermediate transfer recording medium comprising a substrate and a light transparent protective layer provided on one side of the substrate;

providing a first thermal transfer recording medium comprising a substrate and a light transparent ink layer provided on one side of the substrate;

putting the intermediate transfer recording medium and the first thermal transfer recording medium on top of each other so that the light transparent protective layer in the intermediate transfer recording medium faces the light transparent ink layer in the first thermal transfer recording medium;

imagewise heating the assembly to form a light transparent image on the light transparent protective layer in the intermediate transfer recording medium;

providing a second thermal transfer recording medium comprising a substrate and, provided on one side of the substrate, a color ink layer comprising a thermoplastic resin and a colorant;

putting the intermediate transfer recording medium with the light transparent image formed thereon on top of the second thermal transfer recording medium so that the light transparent protective layer on its light transparent image-formed side in the intermediate transfer recording medium faces the color ink layer in the second thermal transfer recording medium;

imagewise heating the assembly to transfer the color ink layer or the colorant contained in the color ink layer onto the light transparent protective layer on its light transparent image-formed side in the intermediate transfer recording medium, whereby a color image is formed on the light transparent protective layer;

putting an object on top of the intermediate transfer recording medium with the light transparent image and the color image formed on its light transparent protective layer so that the light transparent image and the color image face the object; and heating the whole assembly to form a color image, a light transparent image, and a light transparent protective layer on the object.

2. An image formed object comprising an image formed by the method according to claim 1.

3. The image formed object according to claim 2, wherein the thickness of the light transparent image is 0.3 to 5.0 $\mu$m.

4. The image formed object according to claim 2, wherein the light transparent protective layer is composed mainly of a thermoplastic resin having a glass transition point of 50 to 120° C.

5. The image formed object according to claim 4, wherein the thermoplastic resin is at least one member selected from a polyester resin having a number average molecular weight of 2000 to 30000, a vinyl chloride-vinyl acetate copolymer having an average degree of polymerization of 150 to 500, and a homopolymer or copolymer, of a methacrylate monomer, having a weight average molecular weight of 20000 to 80000.

6. The image formed object according to claim 2, wherein the light transparent ink layer for the formation of light transparent image is composed mainly a thermoplastic resin having a glass transition point of 50 to 120° C.

7. The image formed object according to claim 6, wherein the thermoplastic resin is at least one member selected from a polyester resin having a number average molecular weight of 2000 to 30000, a vinyl chloride-vinyl acetate copolymer having an average degree of polymerization of 150 to 500, and a homopolymer or copolymer, of a methacrylate monomer, having a weight average molecular weight of 20000 to 80000.

8. The image formed object according to claim 2, wherein both the light transparent ink layer, for the formation of the light transparent image, and the light transparent protective layer contain respective thermoplastic resins, and the thermoplastic resin contained in the light transparent ink layer and the thermoplastic resin contained in the light transparent protective layer are similar to each other in polymer structure and each have an ester linkage in its molecular structure.

* * * * *